US005501041A

United States Patent [19]

Fischbeck et al.

[11] Patent Number: 5,501,041

[45] Date of Patent: Mar. 26, 1996

[54] WINDOW GUARD FOR CATS

[76] Inventors: Kyra Fischbeck; John P. Boyle, both of 446 E. 76 St. (4C), New York, N.Y. 10021

[21] Appl. No.: 297,036

[22] Filed: Aug. 29, 1994

[51] Int. Cl.[6] ..... E06B 7/00

[52] U.S. Cl. ..... 49/55; 49/57

[58] Field of Search ..... 49/55, 57, 463; 454/221, 224, 278

[56] References Cited

U.S. PATENT DOCUMENTS

| | | | |
|---|---|---|---|
| 269,372 | 12/1882 | Badger | 49/55 |
| 383,582 | 5/1888 | Long | 49/55 X |
| 597,145 | 1/1898 | Hartzell | 49/55 X |
| 2,982,579 | 5/1961 | Greenwald | 49/55 X |
| 3,567,112 | 3/1971 | Wittekind | 49/55 X |
| 4,465,262 | 8/1984 | Itri et al. | 49/55 X |
| 4,787,174 | 11/1988 | Brown | 49/57 X |
| 5,135,413 | 8/1992 | Pannizzo | 49/55 X |
| 5,267,413 | 12/1993 | Hubert et al. | 49/57 |

*Primary Examiner*—Jerry Redman
*Attorney, Agent, or Firm*—Charles E. Baxley

[57] ABSTRACT

A window guard includes a pair of sliding panels, each of which has integrally formed horizontal and vertical flanges. The panels are interlocked to slide relative to each other in order to accommodate various window widths yet, at the same time, maintaining a high degree of rigidity against bending. The panels each include vent openings which admit air without weakening the apparatus.

5 Claims, 3 Drawing Sheets

WINDOW GUARD FOR CATS

BACKGROUND OF THE INVENTION

The present invention relates generally to a window guard apparatus and, more particularly, to a window guard for cats.

Recent literature concerning the behavior patterns of pet cats has noted the incidence of a pattern of behavior known as a high rise syndrome in which a pet cat concentrates its attention so intently on a bird or a moth or another creature outside a window in a high rise dwelling that it seems to forget about the height above the ground and steps or leaps into thin air in pursuit of the hunted creature.

Depending on the circumstances, including the height above the ground and the condition of the ground, this can result in extensive trauma including severe injuries to the forelimbs, chest and jaw. In addition, the impact of the cat's landing on the ground can crush the chest and cause the lungs to collapse.

The widespread incidence of this type of injury has led to a need for a practical low cost window guard which can effectively protect the cat.

Despite the availability of a range of window guard devices, there remains a need for a relatively low cost window guard which can be installed without a need for structural modification or permanent attachment to the window frame or the surrounding wall structure in a dwelling.

OBJECTS AND SUMMARY OF THE INVENTION

It is an object of the present invention to provide a window guard apparatus for cats which can be easily installed in a window without a need for modifications to the window or the surrounding wall structure.

Another object of the present invention is to provide a window guard apparatus which provides protection for a cat but also admits light and air into a dwelling.

Another object of the present invention is to provide a window guard apparatus for cats which is composed of two relatively simple parts which can be manufactured economically, resulting in a relatively low overall cost.

The foregoing and other objects and advantages of the present invention will appear more fully hereinafter.

In accordance with the present invention, there is provided a window guard apparatus for cats which is composed of a pair of sliding panel members. The panel members each include slide portions which allow the panel members to slide relative to each other in order to accommodate windows of different widths. The panel members include vent slots which admit air into a room and a stiffener rib which allows the panel members to be manufactured of a relatively thin material, yet maintain a degree of structural rigidity which provides adequate protection for a cat.

BRIEF DESCRIPTION OF THE DRAWINGS

Other important objects and advantages of the present invention will be apparent from the following detailed description taken in conjunction with the accompanying drawings in which.

DETAILED DESCRIPTION OF THE INVENTION

Figure 1:
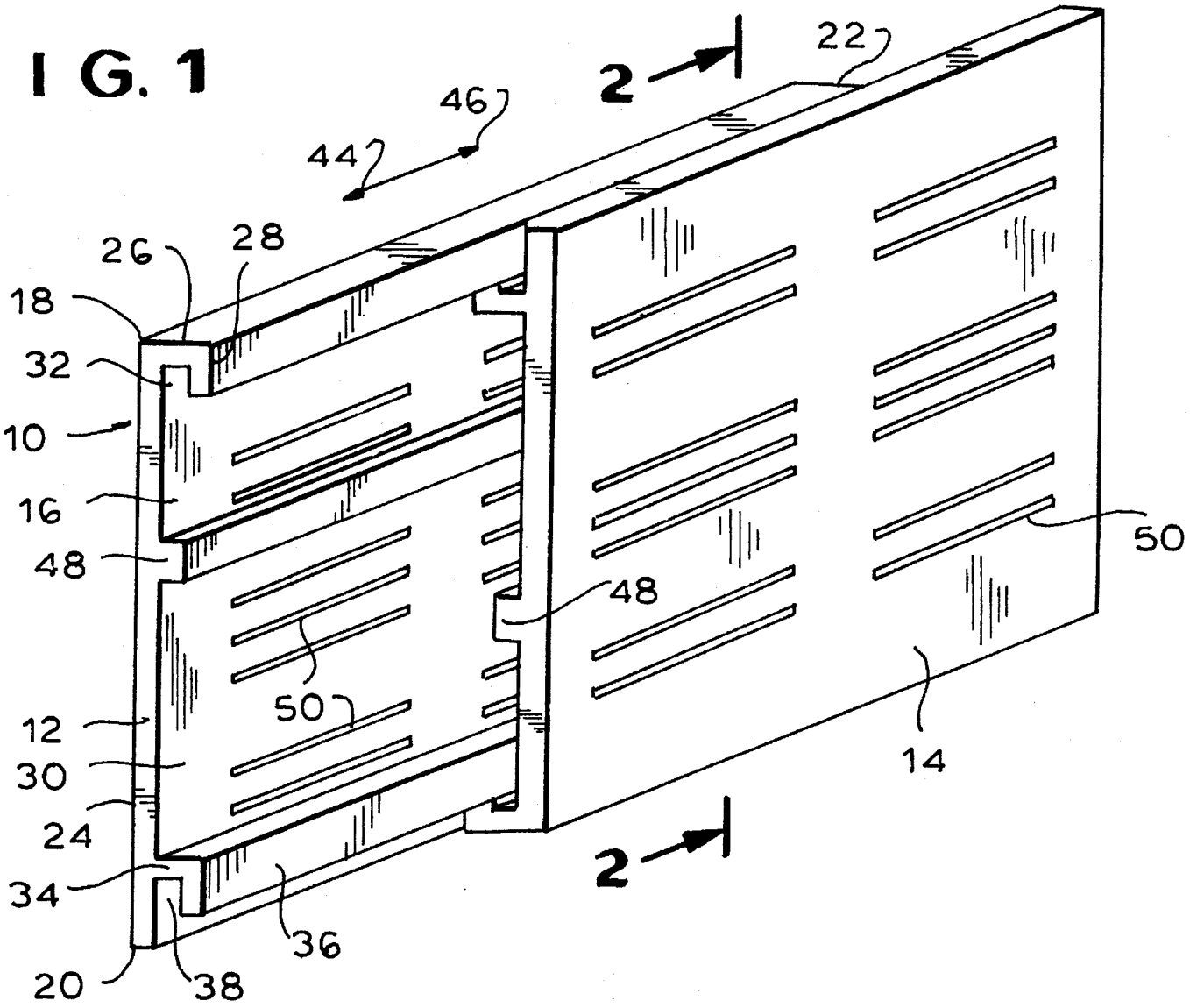
FIG. 1 is an overall perspective view of a window guard for cats in accordance with the present invention.

With reference to the drawings, there is shown in FIG. 1 a window guard 10 for cats which includes a pair of sliding panels 12, 14.

The two panels 12, 14 are identical in construction and corresponding portions have the same reference numbers in each of the Figures.

Each of the panels 12, 14 is formed as an integral member and the panel 12 will be described in detail. Panel 12 includes a flat plate member 16 which has an upper edge 18, a lower edge 20, a right edge 22 and a left edge 24. The upper edge 18 of plate member 16 has a horizontal flange 26 which projects from plate portion 16 and which is connected to a vertical flange 28.

Vertical flange 28 is spaced away from the surface 30 of plate member 16, thereby forming a space which is designated by the reference number 32.

A horizontal flange 34 is disposed proximate to the lower edge 20 of plate member 16. The horizontal flange 34 projects from plate member 16 and is connected to a vertical flange 36. As described above, the vertical flange 36 is spaced away from the surface 30 of plate member 16, thereby forming a space which is designated by reference number 38. The distance between the inside surfaces 40, 42 of the vertical flanges 28, 36 and the surface 30 of the plate member 16 is somewhat larger than the thickness of plate member 16.

The proportions of the spaces 32, 38 between the vertical flanges 28, 36 and the surface 30 of plate member 16 portions enables the vertical flanges of the plate members 16 to be introduced into the spaces 32, 38 and allows the two panels 12, 14 to slide relative to each other in directions shown by arrows 44, 46 in FIG. 1, while remaining interlocked.

The sliding action of these two panels 12, 14 allows a user to adjust the window guard 10 to accommodate windows of different widths.

In addition to facilitating the sliding action of the two panels 12, 14, the horizontal and vertical flanges 26, 28, 34, 36 increase rigidity or resistance to bending of the window guard 10 and thereby provides a high degree of security.

Optionally a longitudinal stiffener rib 48 is formed integrally on the surface 30 of the plate member 16, further increasing the strength of the window guard 10.

The panel members 12, 14 each has a plurality of slots or vent openings 50 which admit air into a dwelling. The horizontal and vertical flanges 26, 28, 36, 38 and the ribs 48 provide such a high degree of stiffness that including of the slots 50 has almost no weakening effect on the window guard.

Figure 2:
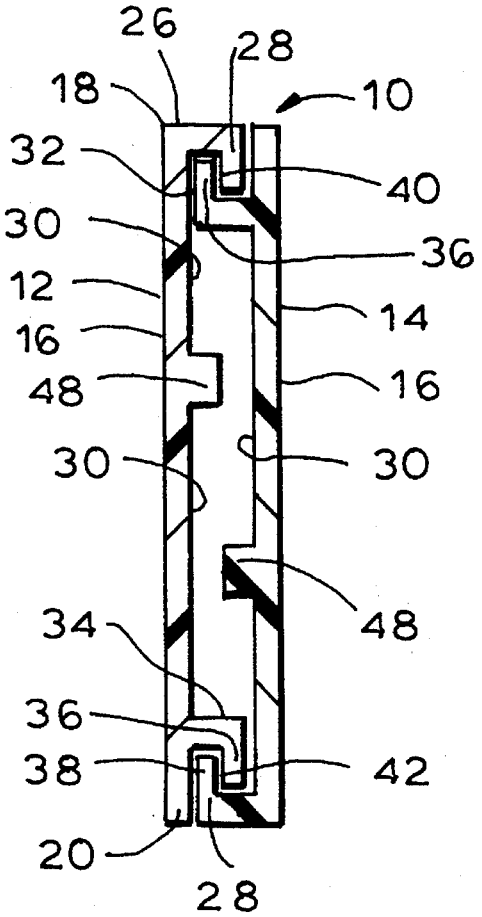
FIG. 2 is a cross-sectional view taken along line 2—2 of FIG. 1.

The two panel members 12, 14, as indicated above, are identical in configuration during manufacture and one of the panels 14 is inverted and interlocked with the panel member 12 during use, as is shown in FIG. 2. Panels 12, 14 are preferably each molded using a plastic material, which may be clear, translucent or opaque, and plate member 16, horizontal and vertical flanges 26, 28, 34, 36, and optionally rib 48 form an integral member. The identical configuration of the panels 12, 14 facilitates use of a single mold during manufacture, thereby reducing tooling costs.

Figure 4:
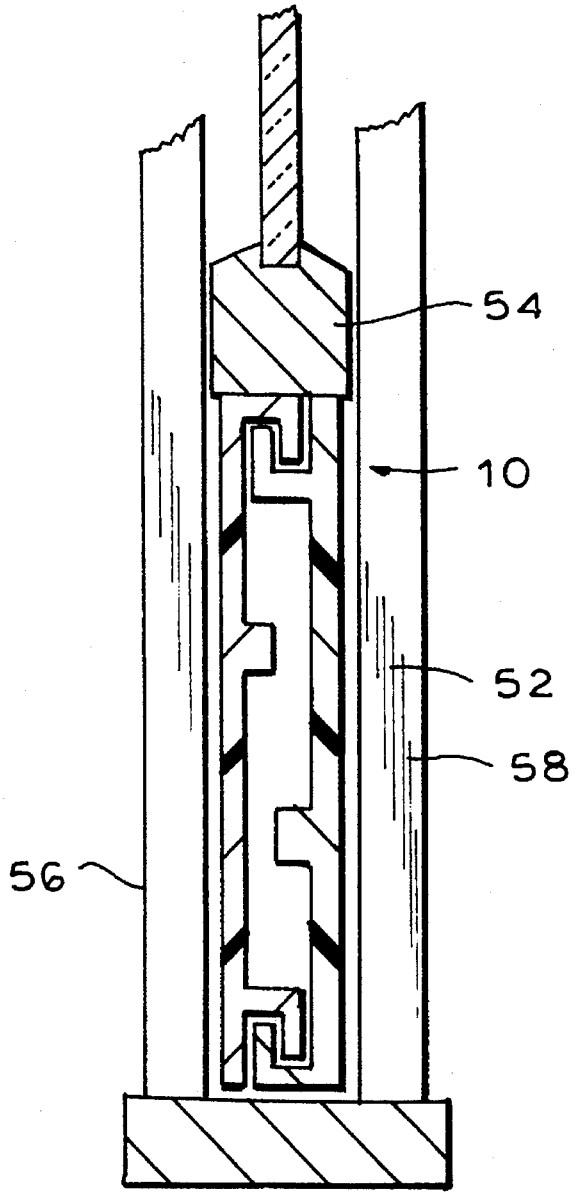
FIG. 4 is a cross-sectional view taken along line 4—4 of FIG. 3.
Figure 3:
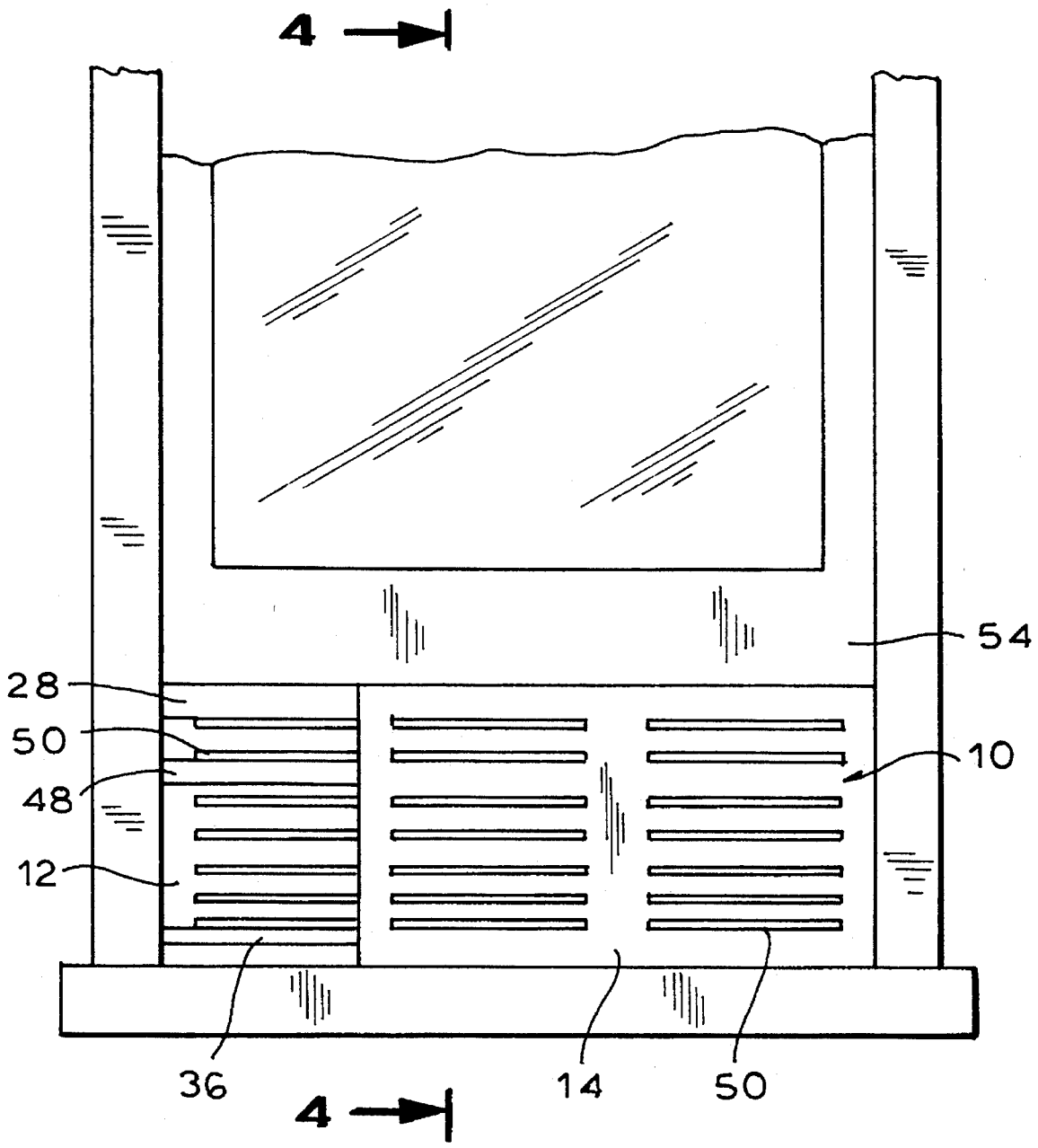
FIG. 3 is an elevational view of the window guard for cats of FIG. 1, with the apparatus shown mounted in a window.

During use, the window guard 10 is inserted in a window frame 52, as is shown in FIGS. 3 and 4, and the sliding window 54 is lowered to contact the window guard 10. The vertical portions 56, 58 of the window frame 52 and the sliding window 54 hold the window guard 10 in a secure manner.

The foregoing specific embodiment of the present invention, as set forth in the specification, is for illustrative purposes only. Various changes and modifications may be made within the spirit and scope of the invention.

We claim:

1. A window guard for cats comprising:

a first panel, and an identical second panel, with said first panel and said second panel each having an upper edge and a lower edge, first sliding connection means mounted proximate to said upper edges and second sliding connection means mounted proximate to said lower edge of said first and said second panels with said sliding connection means maintaining a sliding relationship between said first and said second panels, in which said sliding connection means each include identical horizontal flanges and identical vertical flanges and in which said first and said second panels each have a longitudinal dimension and a lateral dimension.

2. A window guard for cats according to claim 1, further comprising a first longitudinal stiffening rib disposed on said first panel and a second longitudinal stiffening rib disposed on said second panel.

3. A window guard for cats according to claim 1, in which each of said vertical flanges is disposed spaced away from said first and said second panels.

4. A window guard for cats comprising:

a first panel, and an identical second panel, with said first panel and said second panel each having an upper edge and a lower edge, first sliding connection means mounted proximate to said upper edges and second sliding connection means mounted proximate to said lower edge of said first and said second panels with said second sliding connection means maintaining sliding relationship between said first and said second panels, in which said first and said second panels each has an upper and a lower portion and an upper and a lower edge, and in which said sliding connection means mounted on said first panel comprises:

a first horizontal flange, projecting from the upper edge of said first panel, a first vertical flange, projecting from said first horizontal flange, a second horizontal flange projecting from the lower portion of said first panel, a second vertical flange projecting from said horizontal flange, and in which said sliding connection means mounted on said second panel comprises:

a third horizontal flange projecting from the upper portion of said second panel, a third vertical flange projecting from said third horizontal flange, a fourth horizontal flange projecting from the lower edge of said second panel, and a fourth vertical flange projecting from said fourth horizontal flange and with said first horizontal and vertical flanges interlocked with said third horizontal and vertical flanges and with said second horizontal and vertical flanges interlocked with said fourth horizontal and vertical flanges.

5. A window guard for cats comprising a pair of identical panels with each of said panels comprising:

a first edge, a second edge, a first surface, a second surface, a first horizontal flange disposed proximate to said first edge and projecting from said first surface, a first vertical flange projecting from said first horizontal flange and spaced away from said first surface, a second horizontal flange disposed spaced away from said second edge and projecting from said first surface, a second vertical flange projecting from said second horizontal flange, spaced away from said first surface and projecting away from said first vertical flange, with said pair of identical panels comprising a first panel and a second panel, with said first and said second panels interengaged with said second vertical flange of said second panel disposed between said first surface of said first panel and said first vertical flange of said first panel, and with said first vertical flange of said second panel disposed between said first surface of said first panel and said second vertical flange of said first panel.

* * * * *